US009341089B2

(12) United States Patent
Nguyen et al.

(10) Patent No.: US 9,341,089 B2
(45) Date of Patent: May 17, 2016

(54) CAMSHAFT PHASER

(71) Applicant: RB Distribution, Inc., Colmar, PA (US)

(72) Inventors: Tam V. Nguyen, Philadelphia, PA (US); Felix Kaplun, Richboro, PA (US); David P. Cimbolo, Phoenixville, PA (US)

(73) Assignee: RB Distribution, Inc., Colmar, PA (US)

( * ) Notice: Subject to any disclaimer, the term of this patent is extended or adjusted under 35 U.S.C. 154(b) by 0 days.

(21) Appl. No.: 14/245,742

(22) Filed: Apr. 4, 2014

(65) Prior Publication Data

US 2015/0285106 A1 Oct. 8, 2015

(51) Int. Cl.
*F01L 1/34* (2006.01)
*F01L 1/344* (2006.01)

(52) U.S. Cl.
CPC ..... *F01L 1/344* (2013.01)

(58) Field of Classification Search
CPC ..... F01L 1/344; F01L 1/34
USPC ..... 123/90.15, 90.17
See application file for complete search history.

(56) References Cited

U.S. PATENT DOCUMENTS

| | | | | |
|---|---|---|---|---|
| 5,797,361 | A | 8/1998 | Mikame et al. | |
| 6,263,843 | B1 | 7/2001 | Todo et al. | |
| 6,276,321 | B1 | 8/2001 | Lichti et al. | |
| 6,390,043 | B1 | 5/2002 | Niethammer et al. | |
| 6,412,463 | B1 | 7/2002 | Kinugawa | |
| 6,427,654 | B2 | 8/2002 | Golbach et al. | |
| 6,484,678 | B2 | 11/2002 | Kinugawa | |
| 6,516,762 | B1 | 2/2003 | Kinugawa et al. | |
| 6,668,777 | B2 | 12/2003 | Sluka et al. | |
| 6,722,329 | B2 | 4/2004 | Pierik et al. | |
| 6,742,485 | B2 | 6/2004 | Lichti | |
| 6,772,721 | B1 | 8/2004 | Gardner et al. | |
| 6,805,080 | B2 | 10/2004 | Golovatai-Schmidt et al. | |
| 6,883,478 | B2 | 4/2005 | Borraccia et al. | |
| 6,883,480 | B1 | 4/2005 | Sluka et al. | |
| 7,188,596 | B2 | 3/2007 | Kohrs et al. | |
| 7,275,476 | B2 | 10/2007 | Naumann et al. | |
| 7,318,400 | B2 | 1/2008 | Lipke et al. | |
| 7,497,193 | B2 | 3/2009 | Knecht et al. | |
| 7,556,000 | B2 | 7/2009 | Pierik et al. | |
| 7,588,004 | B2 | 9/2009 | Kohrs et al. | |
| 7,721,692 | B2 | 5/2010 | Fischer | |
| 7,823,554 | B2 | 11/2010 | Kleiber | |
| 8,171,904 | B2 * | 5/2012 | Watanabe | 123/90.17 |
| 8,555,837 | B2 | 10/2013 | Hoyer et al. | |

(Continued)

FOREIGN PATENT DOCUMENTS

| | | | |
|---|---|---|---|
| DE | 10258724 | A1 | 6/2004 |
| EP | 1387047 | A2 | 2/2004 |

*Primary Examiner* — Zelalem Eshete
(74) *Attorney, Agent, or Firm* — Blank Rome LLP; Peter S. Weissman; Tara L. Marcus

(57) ABSTRACT

A camshaft phaser that includes a rotor and a sprocket. A plurality of lobes of the sprocket are spaced to receive a plurality of vanes of the rotor, thereby defining retard and advance pressure chambers when the rotor rotates with respect to the sprocket between retard and advance positions. When the rotor rotates between the retard and advance positions, gap surfaces of the lobes cooperate with gap surfaces of the vanes to form fluid gaps therebetween, wings of the lobes fit into receiving surfaces of the vanes, and stop surfaces of the vanes abut the sides of the lobes.

9 Claims, 4 Drawing Sheets

(56) References Cited

U.S. PATENT DOCUMENTS

2002/0029651 A1* 3/2002 Sluka et al. ..... 74/567
2005/0045130 A1 3/2005 White et al.
2009/0044770 A1 2/2009 Scott et al.
2013/0019825 A1 1/2013 Fischer

* cited by examiner

CAMSHAFT PHASER

FIELD OF THE INVENTION

The present invention relates to a camshaft phaser for a timing device of an internal combustion engine. More specifically, the present invention relates to an improved rotor and sprocket design of the camshaft phaser.

BACKGROUND OF THE INVENTION

Internal combustion engines have camshaft phasers for varying the phase relationship between the crankshaft and a camshaft. Camshaft phasers allow the timing of the engine to be optimally adjusted based upon speed and other parameters by enabling relative rotation of the camshaft to the crankshaft.

Examples of some prior art camshaft phasers include U.S. Pat. No. 7,497,193 to Knecht et al.; U.S. Pat. No. 7,318,400 to Lipke et al.; and U.S. Pat. No. 6,772,721 to Gardner et al., the subject matter of each of which is hereby incorporated by reference.

SUMMARY OF THE INVENTION

The present invention provides a rotor for a camshaft phaser that includes a hub that has a plurality of vanes extending radially from the hub and the vanes are spaced from one another, thereby defining pressure chambers therebetween. A first set of the plurality of vanes are substantially identical and each includes opposite first and second sides joined by an end face remote from the hub, a shoulder section proximate the hub that defines a gap surface at the first and second sides, a split leg section at the end face that defines a stop surface at the first and second sides, a curved recess section between the shoulder section and the split leg section that defines a receiving surface at the first and second sides where the curved recess section is narrower than the shoulder and split leg sections.

The present invention may also provide a camshaft phaser that includes a rotor that has a hub with a plurality of vanes extending radially from the hub and the vanes are spaced from one another. A first set of the plurality of vanes are substantially identical and include opposite first and second sides joined by an end face remote from the hub, a shoulder section proximate the hub that defines a gap surface at each of the first and second sides, a split leg section at the end face that defines a stop surface at each of the first and second sides, and a curved recess section is between the shoulder section and the split leg section that defines a receiving surface at each of the first and second sides where the curved recess section is narrower than the shoulder and split leg sections. A sprocket supports the rotor. The sprocket has a ring body extending from a wheel base and a plurality of lobes extending radially inwardly from an inner wall of the ring body such that the lobes are interleaved with the vanes. A first set of the plurality of lobes are substantially identical and each include opposite first and second sides and an end face surface remote from the ring body, a notched section that forms a notch in the inner surface of the ring body at each of the first and second sides, a narrowed end section remote from the ring body that forms a gap surface at each of the first and second sides, and a wing section between the notched section and the narrowed end section forms an outwardly extending wing at each of the first and second sides. The plurality of lobes of the sprocket are spaced to receive the plurality of vanes of the rotor, thereby defining retard and advance pressure chambers when the rotor rotates with respect to the sprocket between retard and advance positions. When the rotor rotates between the retard and advance positions, each of the gap surfaces of one of the first and second sides of the first set of lobes cooperates with each of the gap surfaces of one of the first and second sides of the first set of vanes to form a fluid gap therebetween, each of the wings of the first and second sides of the first set of lobes fits into one of the receiving surfaces of said first and second sides of the first set of vanes, and each of the stop surfaces of the first and second sides of the first set of vanes abuts one of the first and second sides of the first set of lobes.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 1:
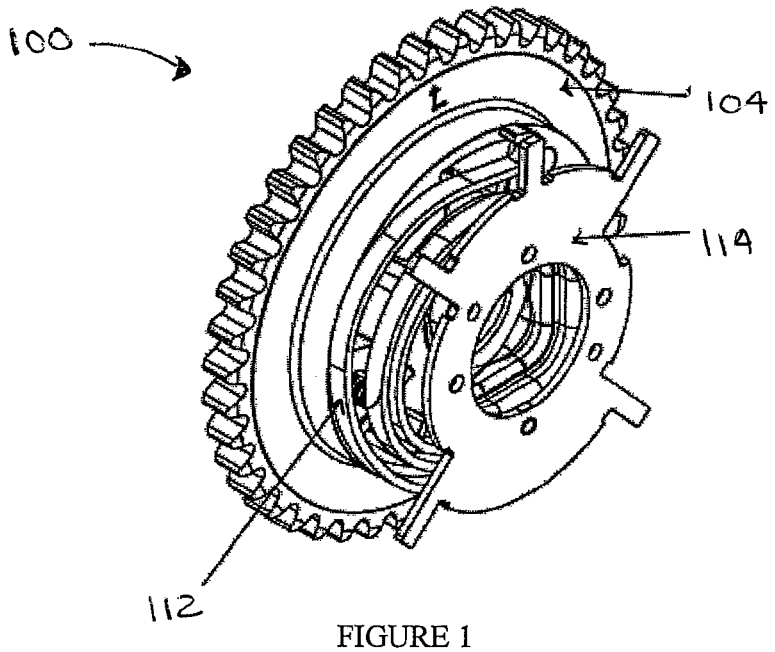
FIG. 1 is a perspective view of a camshaft phaser according to an exemplary embodiment of the present invention.
Figure 2:
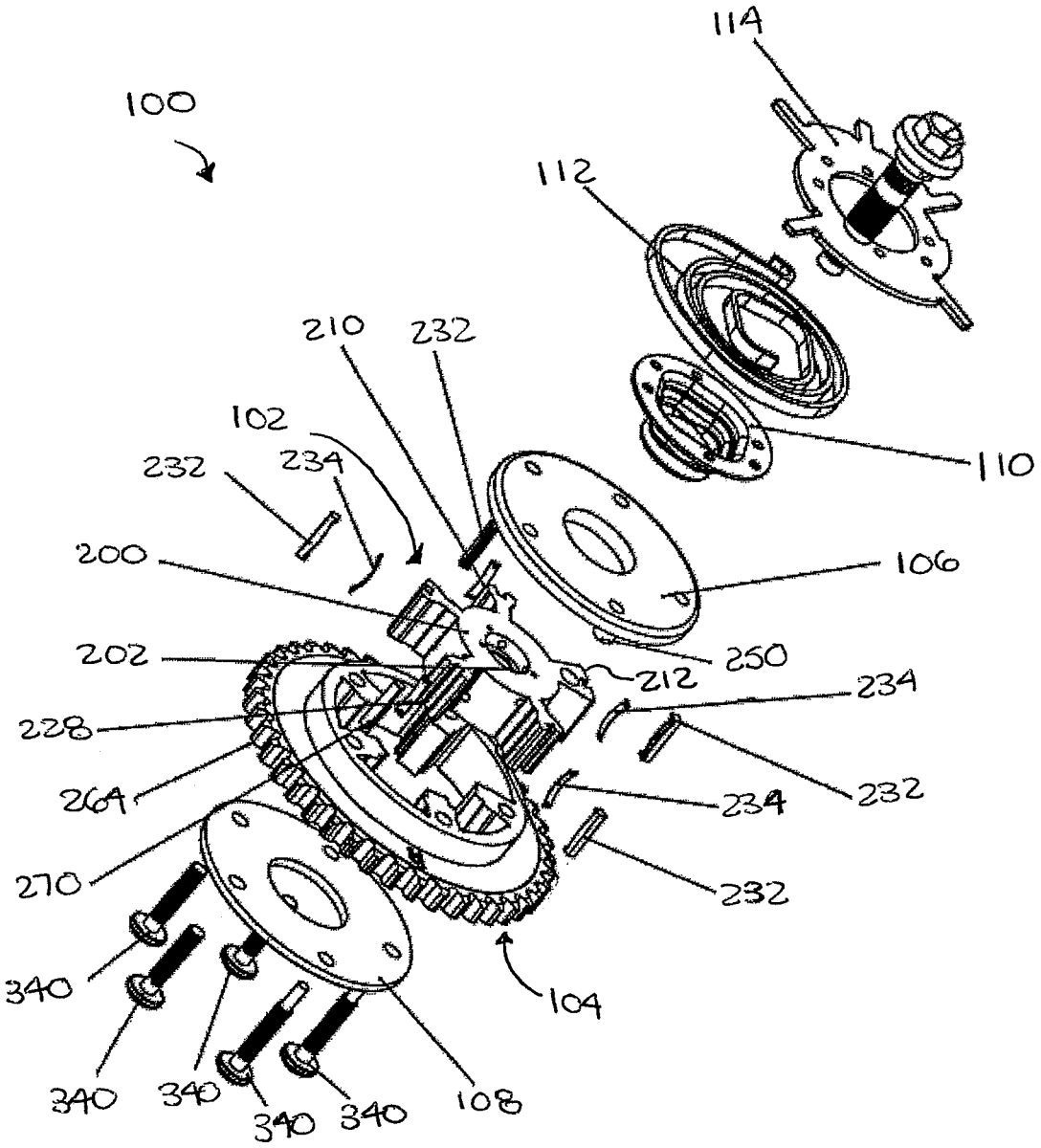
FIG. 2 is an exploded perspective view of the camshaft phaser illustrated in FIG. 1.

Referring to FIGS. 1, 2, 3, 4A, 4B, 4C and 5, a camshaft phaser 100 according to an exemplary embodiment of the present invention is designed to advance and retard the timing of valves of an internal combustion engine. As seen in FIGS. 1 and 2, the camshaft phaser generally includes a rotor 102, a sprocket 104 that supports the rotor 102, front and back covers 106 and 108 on either side of the rotor 102 and sprocket 104, a contiguous block 110 that supports a reset spring 112, and a signal plate 114. All of the components of the camshaft phaser are preferably made of metal. As described in more detail below, the assembled rotor 102 and sprocket 104 have alternating vanes and lobes that define advance and retard position pressure chambers when the rotor 102 rotates with respect to the sprocket 104 in response to fluid pressure.

Figure 3:
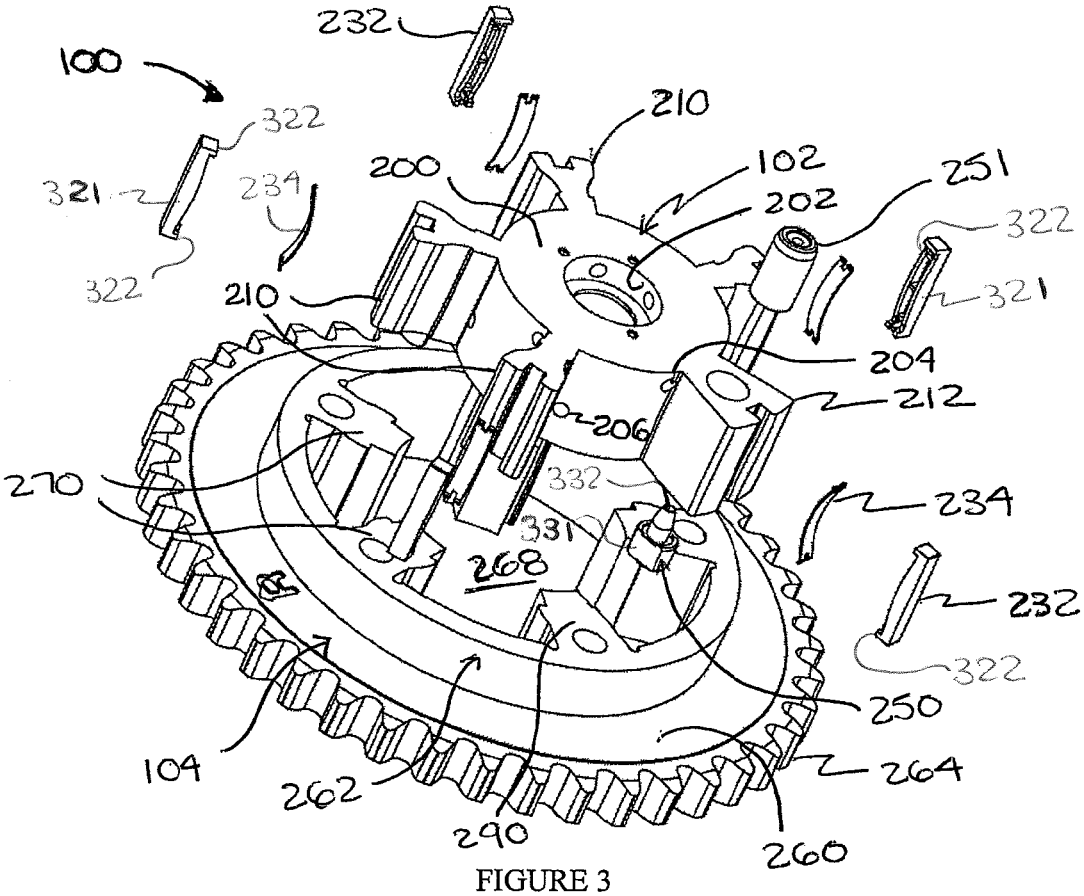
FIG. 3 is an exploded perspective view of a rotor and sprocket of the camshaft phaser illustrated in FIG. 1.
Figure 4A:
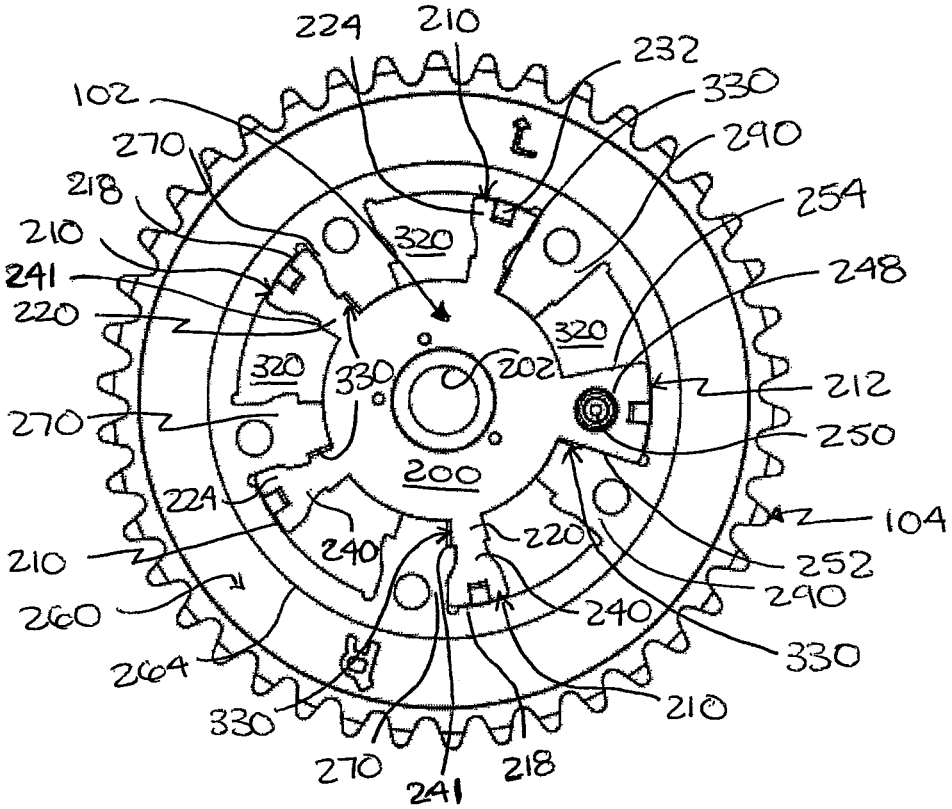
FIG. 4A is an elevational view of the rotor and sprocket illustrated in FIG. 3, showing the rotor received in the sprocket.
Figure 4B:
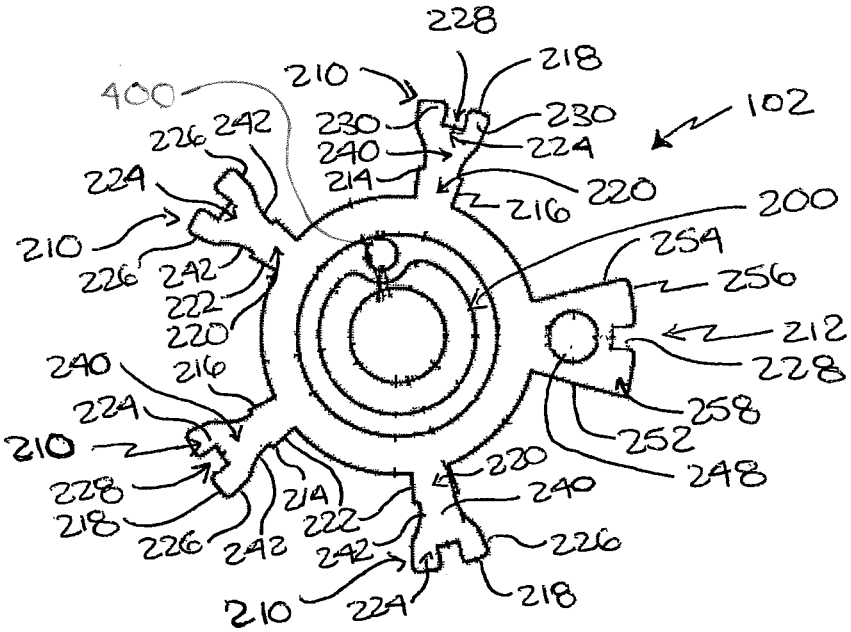
FIG. 4B is an elevational view of the rotor illustrated in FIG. 4A.
Figure 5:
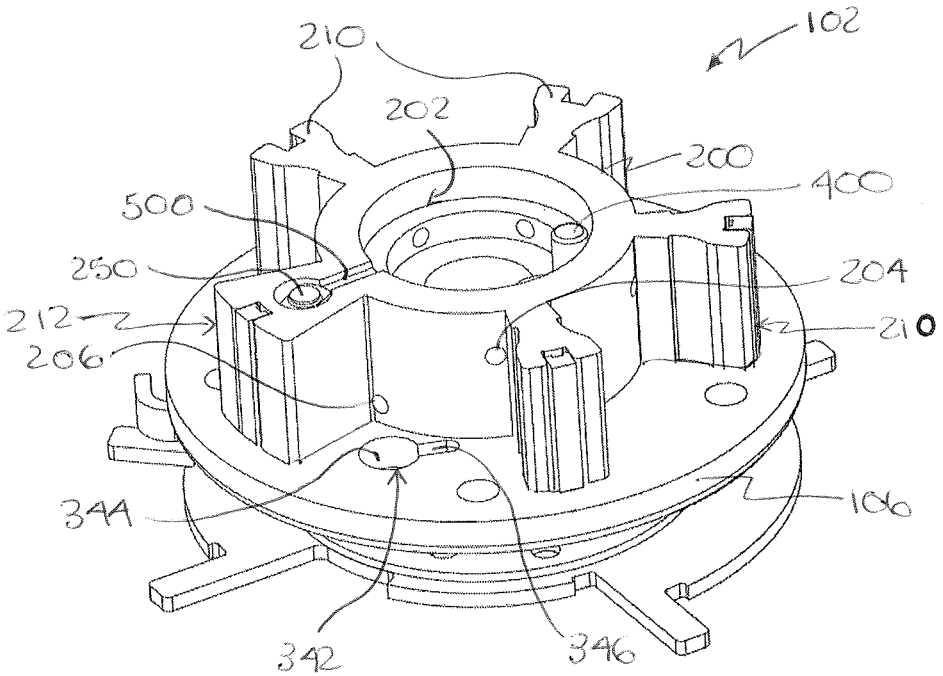
FIG. 5 is a perspective view of the rotor of a front cover illustrated in FIG. 1.

As seen in FIGS. 3, 4A and 4B, the rotor 102 generally includes a central hub 200 with a plurality of vanes 210 and 212 that extend radially outwardly from the hub 200. The plurality of vanes are preferably integral with the hub 200. The central hub 200 is substantially cylindrical with a middle channel 202 that includes retard and advance fluid passages 204 and 206, as seen in FIGS. 3 and 5. A first set of the vanes 210 are substantially identical. The remaining vane 212 of the plurality of vanes is oversized. Each of the substantially identical vanes 210 includes opposite first and second sides 214 and 216 and an end face 218 joining the sides 214 and 216. As best seen in FIGS. 4A and 4B, each of the substantially identical vanes 210 includes three sections: a shoulder section 220 near the hub 200 that defines a gap surface 222 at each side 214 and 216; a split leg section 224 at the end face 218 that defines a stop surface 226 at each side 214 and 216; and a curved recess section 240 between the shoulder and split leg sections 220 and 224 that defines a receiving surface 242 at each of the first and second sides 214 and 216. The curved recess section 240 is narrower than the shoulder section 220 to form a lip 241 therebetween. The curved recess section 240 curves to widen out towards the split leg section 224. The split leg section 224 includes a block cavity 228 at the end face 218 that is between two leg segments 230. The block cavity 228 is configured to receive a wiping block 232 and associated spring 234 (FIG. 2) that seals to prevent leakage between pressure chambers. The blocks 232 prevent advance or retard fluids from flowing between adjacent chambers 320 by direct preload of spring 234. The block 232 is preferably plastic to keep the rotor 102 rotating smoothly. Each block 232 may have a block shell body 321 with shoulders 322 on either end, as seen in FIG. 3. The block shell body 321 is sized to accommodate the spring 234 between its shoulders 322.

The oversized vane 212 of the rotor 102 is larger than the substantially identical vanes 210 and includes a central bore 248 adapted to receive a locking pin 250 and sleeve 251 (FIG. 3). The pin 250 preferably has a rounded head 331 with flat sides (FIG. 3) and stem 332 (FIG. 3) that supports a compression spring to facilitate movement of the pin 250 between locked and unlocked positions. The oversized vane 212 includes opposite first and second sides 252 and 254 that are joined by an end face surface 256. The first and second sides 252 and 254 taper outwardly from the hub 200, as seen in FIG. 4B. Like the vanes 210, the oversized vane 212 includes a split leg section 258 that has one of the block cavities 228 for receiving one of the wiping blocks 232 and spring 234. Unlike the vanes 210, the oversized vane 212 does not include shoulder and curved recess sections such that its sides 252 and 254 are generally straight. The oversized vane 212 preferably includes a groove 500 (FIG. 5) in fluid communication with the bore 248 that accepts the locking pin 250. The groove 500 is in the surface of the vane 212 opposite front cover 106 and extends between the bore 248 and the channel 202 of the rotor's hub 200 to allow excess oil to flow out of the rotor's channel 202 to the outside of the phaser 100 to avoid back up pressure when the excess oil fills up the channel 202. The excess oil flows into the rotor's channel 202 from the gap between the rotor's channel 202 and the locking pin 250 when the locking pin 250 moves to the unlocked position, that is when the pin 250 is being pushed up by the pressurized oil. The rotor 102 may include an alignment pin 400 (FIGS. 4B and 5) that aligns the phaser 100 with a cam shaft (not shown).

Figure 4C:
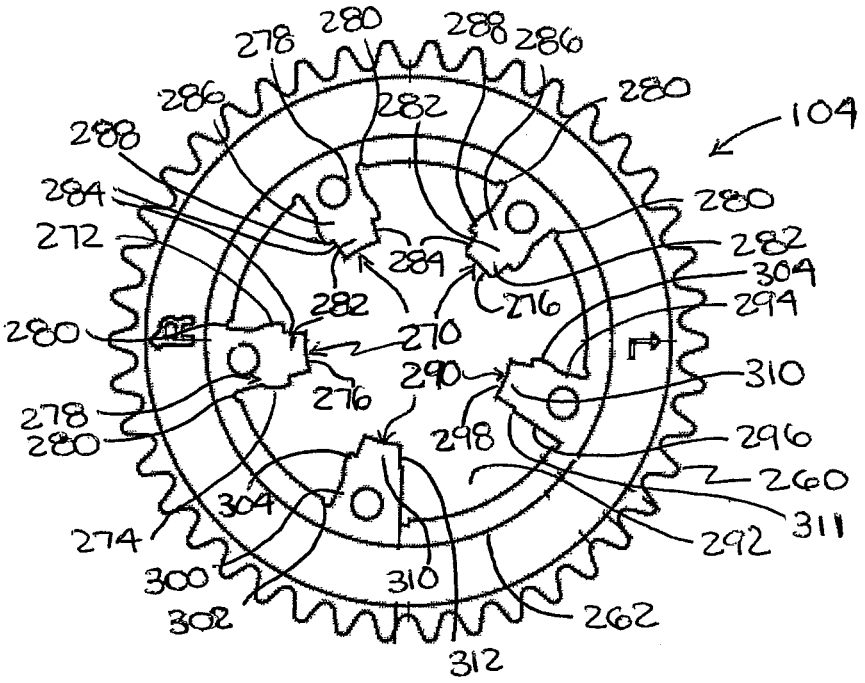
FIG. 4C is an elevational view of the sprocket illustrated in FIG. 4A.

As seen in FIGS. 3, 4A and 4C, the sprocket 104 of the camshaft phaser 100 generally includes a wheel base 260 and a ring body 262. The wheel base 260 may include an outer perimeter of gear teeth 264. As best shown in FIG. 3, the ring body 262 extends upward and outward from the top surface of the wheel base 260 and is inset from the outer perimeter 264 such that the diameter of the ring body 262 is smaller than the diameter of the wheel base 260. A plurality of lobes 270 and 290 extend radially inwardly from an inner surface of the ring body 262. The number of lobes preferably corresponds to the number of vanes 210, 212 of the rotor 102 and define a receiving area 268 for the rotor 102. A first set of the lobes 270 are substantially identical. Each of the substantially identical lobes 270 includes an opposite first and second sides 272 and 274 that are joined by an end face 276 at the distal end of the lobes 270 remote from the ring body 262. Each end face 276 is preferably convexly curved to substantially match the curvature of the outer surface of the rotor's hub 200. Each substantially identical lobe 270 includes three sections 278, 282, and 286. The notched section 278 forms a small curved notch 280 in the inner surface of the ring body 262 at the base of the first and second sides 272 and 274 where the sides 272 and 274 meet the ring body 262. The narrowed end section 282 is at the distal end of the lobes 270 remote from the ring body 262 and forms a gap surface 284 at the first and second sides 272 and 274. The wing section 286 is located between the notched section 278 and the narrowed end section 282 of each vane 270. The wing section 286 of each vane 270 has a wing 288 projecting outwardly from both sides 272 and 274.

A second set of the lobes of the sprocket 104 includes two lobes 290 that define an area 292 therebetween for receiving the oversized vane 212 of the rotor 102. The two lobes 290 include opposite first and second sides 294 and 296 joined by an end face 298 opposite the ring body 262. The end face 298 is preferably curved to substantially match the curvature of the outer surface of the hub 200. Like the substantially identical lobes 270, each lobe 290 includes a notched section 300 that forms notches 302 in the inner surface of the ring body 262 at either side 294 and 296. The first side 294 (remote from area 292) of each lobe 290 includes an outwardly projecting wing 304. The second side 296 of each lobe 290 is substantially straight. Also, like the substantially identical lobes 270, each lobe 290 includes a narrowed end section 310 at the end face 298 that forms a gap surface 312 at each side 294 and 296. The narrowed end section 310 forms a lip 311, as seen in FIG. 4C.

As seen in FIG. 4A, the rotor 102 is received in the sprocket 104 such that the vanes 210 and 212 alternate/interleave with the lobes 270 and 290 to define pressure chambers 320. The end faces 218 of the rotor 102 are preferably slightly spaced from the inner surface of the sprocket ring body 262 to facilitate rotation of the rotor 102 with respect to sprocket 104. When the rotor 102 rotates between retard and advance positions, the gap surfaces 312 of the substantially identical lobes 270 cooperate with the gap surfaces 222 of the substantially identical vanes 210 of the rotor 102 are configured to form fluid gaps 330 therebetween, as seen in FIG. 4A. Also, the wings 288 of the substantially identical lobes 270 of the sprocket 104 fit into the cooperating receiving surfaces 242 of the substantially identical vanes 210, and the stop surfaces 226 of the substantially identical vanes 210 abut the first and second sides 272 and 274 of the substantially identical lobes 270 as the rotor 102 moves with respect to the sprocket 104.

The oversized vane 212 of the rotor 102 fits in the area 292 (FIG. 4C) between the lobes 290 of the sprocket 104 such that the sides 252 and 254 of the oversized vane 212 abut the second sides 296 of the lobes 290 as the rotor 102 rotates with respect to the sprocket 104. The wings 304 projecting from the first sides 294 of the lobes 290 are received in the receiving surfaces 242 of the substantially identical vanes 210 and the gap surfaces 312 of the lobes 290 form the fluid gaps 330 with the gap surfaces 222 of the vanes 210. The oversized vane 212 receives the locking pin 250 and its spring for locking and unlocking purposes.

As seen in FIGS. 1 and 2, the front cover 106 of the camshaft phaser covers the rotor 102 and the back cover 108 is adjacent the wheel base 260 of the sprocket 104. The front and back covers 106 and 108 are secured together by bolts 340 extending through cooperating holes in the covers 106 and 108, thereby sandwiching the rotor 102 and sprocket 104 therebetween.

The inside surface of the front cover 106 includes a key shaped groove 342 (FIG. 5) that accepts the locking pin 250. When the rotor 102 is in the retard position with respect to the sprocket 104, the locking pin 250 engages the key shaped groove 342, thereby locking the camshaft phaser in place. The groove 342 preferably has a main part 344 and a tail part 346 extending therefrom, as seen in FIG. 5. When pressurized fluid, such as oil, enters the camshaft phaser 100, it flows into the advance passages 206 in the rotor's hub 200 and in the groove portion of the key shaped groove 342 via the fluid gaps 330 between the rotor 102 and sprocket 104. The notches 302 preferably accepts excess oil that has not completely drained out of the phaser through the advance or retard oil ports. Otherwise such excess oil would prevent the rotor from properly moving between advance and retard positions. The locking pin 250 then moves into the rotor 102 and disengages from the front cover 106 to unlock the camshaft phaser when the oil pressure overcomes the compression spring force of the locking pin's spring. The rotor 102 will then shill and rotate to the advance position when the oil pressure overcomes the force of the reset spring 112. The reset spring 112 pulls the rotor 102 back to the retard position when the pressurized oil changes flow direction from advance to retard passages 204 and 206, as required for proper engine timing.

While a particular embodiment has been chosen to illustrate the invention, it will be understood by those skilled in the art that various changes and modifications can be made therein without departing from the scope of the invention as defined in the appended claims.

What is claimed is:

1. A camshaft phaser, comprising:

a rotor including a hub having a plurality of vanes extending radially from said hub, said vanes being spaced from one another, a first set of said plurality of vanes being substantially identical, each of said vanes of said first set including, opposite first and second sides joined by an end face remote from said hub, a shoulder section proximate said hub defining a gap surface at each of said first and second sides, a split leg section at said end face defining a stop surface at each of said first and second sides, a curved recess section between said shoulder section and said split leg section defining a receiving surface at each of said first and second sides, said curved recess section being narrower than said shoulder and split leg sections, and one of said plurality of vanes being an oversized vane that is larger than each of said vanes of said first set of vanes, said oversized having substantially straight sides and said oversized vane including groove in fluid communication with a central channel of said hub and said groove extending in a radial direction from said central channel; and a sprocket supporting said rotor, said sprocket having a ring body extending from a wheel base and a plurality of lobes extending radially inwardly from an inner wall of said ring body such that said lobes are interleaved with said vanes, a first set of said plurality of lobes being substantially identical, each of said lobes of said first set including, opposite first and second sides and an end face surface remote from said ring body, a notched section that forms a notch in said inner surface of said ring body at each of said first and second sides, a narrowed end section remote from said ring body forming a gap surface at each of said first and second sides, a wing section between said notched section and said narrowed end section forming an outwardly extending wing at each of said first and second sides, wherein said plurality of lobes of said sprocket are spaced to receive said plurality of vanes of said rotor, thereby defining retard and advance pressure chambers when said rotor rotates with respect to said sprocket between retard and advance positions, and wherein when said rotor rotates between said retard and advance positions, each said gap surfaces of one of said first and second sides of said first set of lobes cooperates with each of said gap surfaces of one of said first and second sides of said first set of vanes to form a fluid gap therebetween, each of said wings of said first and second sides of said first set of lobes fits into one of said receiving surfaces of said first and second sides of said first set of vanes, and each of said stop surfaces of said first and second sides of said first set of vanes abuts one of said first and second sides of said first set of lobes, and a second set of said plurality lobes different from said first set of lobes, each lobe of said second set of lobes including, opposite first and second sides and an end face remote from said ring body, a notched section that forms a notch in said inner surface of said ring body proximate said first and second sides, a wing extending outwardly from only said first side, and said second side opposite said wing is substantially straight, said second side having no wing, and a narrowed end section at said end face that forms a gap surface at each of said first and second sides, wherein said oversized vane is received between said second sides of said lobes of said second set such that said substantially straight sides of said oversize vane adapted to abut said substantially straight second sides of said lobes of said second set.

2. A camshaft phaser according to claim 1, wherein said oversized vane ha vi a bore for accommodating a locking pin.

3. A camshaft phaser according to claim 2, wherein said oversized vane has a groove in fluid communication with said bore and a central channel of said hub of said rotor.

4. A camshaft phaser according to claim 3, wherein each of said end faces of said first and second sets of said plurality of lobes being curved to substantially match a curvature of an outer surface of said hub of said rotor.

5. A camshaft phaser according to claim 1, wherein said hub includes retard and advance fluid passages.

6. A camshaft phaser according to claim 1, wherein each end face of said plurality of vanes includes a block cavity for accommodating a spring and block for sealing said pressure chambers.

7. A camshaft phaser according to claim 1, further comprising front and back covers sandwiching said rotor and sprocket.

8. A camshaft phaser according to claim 7, wherein said front cover includes a key shaped groove that receives a locking pin.

9. A camshaft phaser according to claim 8, wherein said first set of vanes of said rotor includes four vanes and said first set of lobes of said sprocket includes three lobes.

* * * * *